US006178662B1

(12) United States Patent
Legatzke

(10) Patent No.: US 6,178,662 B1
(45) Date of Patent: Jan. 30, 2001

(54) DISPERSED-AIR FOOTPAD

(76) Inventor: David K. Legatzke, 5904 Alonzo St., Encino, CA (US) 91316

( * ) Notice: Under 35 U.S.C. 154(b), the term of this patent shall be extended for 0 days.

(21) Appl. No.: 09/480,065

(22) Filed: Jan. 10, 2000

Related U.S. Application Data

(63) Continuation-in-part of application No. 09/243,074, filed on Feb. 2, 1999, now abandoned.

(51) Int. Cl.[7] ..... A43B 13/20
(52) U.S. Cl. ..... 36/3 R; 36/29; 36/43
(58) Field of Search ..... 36/28, 43, 29, 36/3 R, 3 B, 141

(56) References Cited

U.S. PATENT DOCUMENTS

| | | |
|---|---|---|
| 52,217 | 7/1918 | Haynes . |
| D. 66,952 | 3/1925 | Pierce . |
| D. 76,541 | 10/1928 | Hopwood . |
| D. 87,795 | 9/1932 | Regan . |
| D. 88,763 | 12/1932 | Fowler . |
| D. 99,934 | 6/1936 | Fowler . |
| D. 112,429 | 12/1938 | Tebbutt . |
| D. 120,316 | 4/1940 | Reeves . |
| D. 124,794 | 1/1941 | Kavenagh et al. . |
| D. 129,700 | 9/1941 | Crossman . |
| D. 133,176 | 7/1942 | Gregg . |
| D. 135,347 | 3/1943 | Pierson . |
| D. 144,356 | 4/1946 | Colwell . |
| D. 146,505 | 3/1947 | Kavenagh . |
| D. 163,960 | 7/1951 | Oakley . |
| D. 169,556 | 5/1953 | Maling . |
| D. 173,134 | 10/1954 | Babcock . |
| D. 185,462 | 6/1959 | Ratner . |
| D. 185,654 | 7/1959 | Zerkowitz . |
| D. 193,958 | 10/1962 | Semme . |
| D. 208,248 | 8/1967 | Ford . |
| D. 235,701 | 7/1975 | Famolare, Jr. . |
| D. 240,281 | 6/1976 | Russell . |
| D. 241,586 | 9/1976 | Sebestik . |
| D. 242,091 | 11/1976 | Tornero . |
| D. 244,642 | 6/1977 | Famolare, Jr. . |
| D. 245,734 | 9/1977 | Jacobs . |
| D. 247,201 | 2/1978 | Krome . |
| D. 247,658 | 4/1978 | Keen . |
| D. 253,500 | 11/1979 | Famolare, Jr. . |
| D. 255,172 | 6/1980 | Finn . |
| D. 257,647 | 12/1980 | Combaret . |
| D. 260,572 | 9/1981 | Greenblatt et al. . |
| D. 264,394 | 5/1982 | Hlustik . |
| D. 265,436 | 7/1982 | Vermonet . |
| D. 266,287 | 9/1982 | Blissett et al. . |
| D. 268,299 | 3/1983 | Argyropoulos . |

(List continued on next page.)

*Primary Examiner*—M. D. Patterson
(74) *Attorney, Agent, or Firm*—Kleinberg & Lerner LLP; Marshall A. Lerner; Finn T. Simmensen

(57) ABSTRACT

For use in a sole, insole, or heel portion of a footwear article, a footpad is described, having an upper surface on which are disposed a plurality of resilient lugs. The top surfaces of the lugs define a foot supporting surface wherein mutually parallel, spaced-apart edges of adjacent lugs define a complementary arrangement of top surfaces. The side surfaces of adjacent lugs define therebetween a void which extends lattice-like over the footpad. With gentle compression and release, the side surfaces of adjacent lugs expand into the void, and retreat therefrom, cyclically expelling and ingesting air beneath the foot. With heavy compression, the top surfaces of adjacent lugs are approximated to one another to provide a substantially continuous and substantially uniformly supportive foot-supporting surface. Structures selectively providing for preferred combinations of ventilation, cushioning, and stable and comfortable support for bearing heavy loads are described. The selective provision of enhanced support for heavy load bearing parts of the foot is described.

6 Claims, 5 Drawing Sheets

U.S. PATENT DOCUMENTS

| | | |
|---|---|---|
| D. 269,139 | 5/1983 | Stubblefield . |
| D. 270,780 | 10/1983 | Hlustik . |
| D. 270,870 | 10/1983 | Tilles . |
| D. 271,633 | 12/1983 | Casetta . |
| D. 273,246 | 4/1984 | Tonkel . |
| D. 273,632 | 5/1984 | Ueda . |
| D. 275,145 | 8/1984 | Glatz . |
| D. 278,852 | 5/1985 | Michaeli . |
| D. 280,356 | 9/1985 | Austin . |
| D. 280,568 | 9/1985 | Stubblefield . |
| D. 280,950 | 10/1985 | Austin et al. . |
| D. 281,032 | 10/1985 | Austin . |
| D. 281,460 | 11/1985 | Parker . |
| D. 284,519 | 7/1986 | Braga et al. . |
| D. 285,984 | 10/1986 | Tong et al. . |
| D. 286,342 | 10/1986 | Stubblefield . |
| D. 289,341 | 4/1987 | Turner . |
| D. 289,943 | 5/1987 | Liebscher et al. . |
| D. 290,543 | 6/1987 | Yonkers . |
| D. 290,900 | 7/1987 | Schornstein et al. . |
| D. 294,537 | 3/1988 | Le . |
| D. 295,459 | 5/1988 | Zuidema et al. . |
| D. 296,151 | 6/1988 | Mourad . |
| D. 296,724 | 7/1988 | Peterson . |
| D. 296,952 | 8/1988 | Brown et al. . |
| D. 297,981 | 10/1988 | Gerber et al. . |
| D. 298,285 | 11/1988 | Tong . |
| D. 298,683 | 11/1988 | Kelley et al. . |
| D. 299,185 | 1/1989 | Selbiger . |
| D. 299,681 | 2/1989 | Miller et al. . |
| D. 299,887 | 2/1989 | Diaz . |
| D. 299,983 | 2/1989 | Zuidema et al. . |
| D. 301,391 | 6/1989 | Duclos et al. . |
| D. 301,392 | 6/1989 | Le . |
| D. 301,936 | 7/1989 | Swett . |
| D. 302,351 | 7/1989 | Brill . |
| D. 305,381 | 1/1990 | Mitsui . |
| D. 307,510 | 5/1990 | Issler . |
| D. 317,974 | 7/1991 | Austin . |
| D. 319,724 | 9/1991 | Issler . |
| D. 319,725 | 9/1991 | Claveria . |
| D. 320,690 | 10/1991 | Lucas . |
| D. 321,776 | 11/1991 | Hatfield . |
| D. 321,973 | 12/1991 | Hatfield . |
| D. 322,156 | 12/1991 | Hase . |
| D. 323,422 | 1/1992 | Lucarelli . |
| D. 325,805 | 5/1992 | Herber . |
| D. 325,814 | 5/1992 | Benatti et al. . |
| D. 326,014 | 5/1992 | Issler . |
| D. 326,074 | 5/1992 | Himuro et al. . |
| D. 326,355 | 5/1992 | Cotsidas . |
| D. 329,532 | 9/1992 | Greene . |
| D. 329,938 | 10/1992 | Lucas . |
| D. 330,629 | 11/1992 | Bramani . |
| D. 331,488 | 12/1992 | Norton et al. . |
| D. 331,490 | 12/1992 | Bramani . |
| D. 331,492 | 12/1992 | Tonkel et al. . |
| D. 331,832 | 12/1992 | Issler . |
| D. 332,004 | 12/1992 | Blissett . |
| D. 332,863 | 2/1993 | Lucas . |
| D. 334,833 | 4/1993 | Blissett . |
| D. 335,022 | 4/1993 | Lozano . |
| D. 336,771 | 6/1993 | Hatfield et al. . |
| D. 337,880 | 8/1993 | Foster . |
| D. 339,463 | 9/1993 | Dyer et al. . |
| D. 339,465 | 9/1993 | Teague . |
| D. 340,129 | 10/1993 | Blissett . |
| D. 340,130 | 10/1993 | Blissett . |
| D. 340,571 | 10/1993 | Novy . |
| D. 341,246 | 11/1993 | Lucarelli et al. . |
| D. 341,700 | 11/1993 | Avar . |
| D. 342,376 | 12/1993 | James . |
| D. 343,052 | 1/1994 | Novy . |
| D. 343,506 | 1/1994 | Kusuki et al. . |
| D. 344,848 | 3/1994 | Smith . |
| D. 345,243 | 3/1994 | Hatfield . |
| D. 347,105 | 5/1994 | Johnson . |
| D. 347,106 | 5/1994 | Sell, Jr. et al. . |
| D. 349,392 | 8/1994 | Noel . |
| D. 350,016 | 8/1994 | Passke et al. . |
| D. 350,430 | 9/1994 | Pallera . |
| D. 351,718 | 10/1994 | Novy . |
| D. 352,156 | 11/1994 | Purdom . |
| D. 352,157 | 11/1994 | Merceron . |
| D. 352,597 | 11/1994 | Cohen . |
| D. 353,258 | 12/1994 | Issler . |
| D. 354,388 | 1/1995 | Saez . |
| D. 354,389 | 1/1995 | Howlett et al. . |
| D. 354,845 | 1/1995 | Bramani . |
| D. 356,668 | 3/1995 | Lobosco et al. . |
| D. 356,671 | 3/1995 | Blanchini . |
| D. 356,884 | 4/1995 | Ho . |
| D. 357,571 | 4/1995 | Mitsui . |
| D. 358,929 | 6/1995 | Peterson . |
| D. 361,881 | 9/1995 | Hatfield . |
| D. 363,371 | 10/1995 | Werman . |
| D. 363,815 | 11/1995 | Lucarelli . |
| D. 364,265 | 11/1995 | Murray . |
| D. 364,728 | 12/1995 | Nozu et al. . |
| D. 366,354 | 1/1996 | Yoshikawa et al. . |
| D. 366,756 | 2/1996 | Forland et al. . |
| D. 368,577 | 4/1996 | Mitsui et al. . |
| D. 368,795 | 4/1996 | Tanaka et al. . |
| D. 369,234 | 4/1996 | Fabio . |
| D. 369,235 | 4/1996 | Senda et al. . |
| D. 369,236 | 4/1996 | Maltby . |
| D. 371,893 | 7/1996 | Kayano et al. . |
| D. 372,575 | 8/1996 | Finn . |
| D. 372,576 | 8/1996 | Mills et al. . |
| D. 375,619 | 11/1996 | Backus et al. . |
| D. 377,109 | 1/1997 | Manfredi . |
| D. 377,260 | 1/1997 | Bramani . |
| D. 378,318 | 3/1997 | James . |
| D. 379,259 | 5/1997 | Kayano . |
| D. 379,861 | 6/1997 | Wunsch . |
| D. 379,864 | 6/1997 | Kayano . |
| D. 380,889 | 7/1997 | Earle . |
| D. 383,299 | 9/1997 | Yun . |
| D. 383,893 | 9/1997 | Leick . |
| D. 386,590 | 11/1997 | Cass . |
| D. 386,892 | 12/1997 | Jenkins . |
| D. 387,193 | 12/1997 | Glicksman et al. . |
| D. 387,890 | 12/1997 | Faulconer et al. . |
| D. 388,241 | 12/1997 | Merceron . |
| D. 388,596 | 1/1998 | Lozano . |
| D. 389,295 | 1/1998 | Kelchak . |
| D. 389,991 | 2/1998 | Elliott . |
| D. 390,344 | 2/1998 | Elliott . |
| D. 391,746 | 3/1998 | Rask . |
| D. 392,449 | 3/1998 | Worthington . |
| D. 394,940 | 6/1998 | Vint . |
| D. 395,338 | 6/1998 | Teague . |
| D. 395,341 | 6/1998 | Greenberg . |
| D. 397,235 | 8/1998 | Bouret . |
| D. 398,143 | 9/1998 | Meyer . |
| D. 401,040 | 11/1998 | Schneider . |
| D. 401,042 | 11/1998 | Davis . |
| D. 401,044 | 11/1998 | Heine . |
| D. 401,045 | 11/1998 | Greenberg . |
| D. 401,746 | 12/1998 | Brooks et al. . |
| D. 402,457 | 12/1998 | Greenberg . |

| | | | | |
|---|---|---|---|---|
| D. 404,545 | | 1/1999 | Greenberg . | |
| D. 404,549 | | 1/1999 | Greenberg . | |
| D. 404,551 | | 1/1999 | Greenberg . | |
| D. 404,898 | | 2/1999 | Hudson . | |
| D. 407,891 | | 4/1999 | Edwards . | |
| D. 408,119 | | 4/1999 | Greenberg . | |
| D. 408,618 | | 4/1999 | Wilborn et al. . | |
| D. 408,972 | | 5/1999 | Greenberg . | |
| D. 408,977 | | 5/1999 | Greenberg . | |
| D. 409,361 | | 5/1999 | Greenberg . | |
| D. 409,362 | | 5/1999 | Turner et al. . | |
| D. 409,825 | | 5/1999 | Greenberg . | |
| D. 412,051 | | 7/1999 | Fogg . | |
| D. 412,238 | | 7/1999 | Greenberg . | |
| D. 412,612 | | 8/1999 | Boyer . | |
| D. 413,713 | | 9/1999 | Hernandez . | |
| D. 414,319 | | 9/1999 | Werman . | |
| D. 414,594 | | 10/1999 | Parisotto . | |
| D. 414,922 | | 10/1999 | Wright . | |
| 485,459 | | 11/1892 | Crocker . | |
| 1,680,147 | | 8/1928 | Gilowitz . | |
| 2,326,198 | | 8/1943 | Brandel et al. . | |
| 2,394,454 | | 2/1946 | Kappeler . | |
| 2,405,498 | | 8/1946 | Gregg . | |
| 3,180,039 | | 4/1965 | Burns . | |
| 3,225,463 | | 12/1965 | Burnham . | |
| 3,494,055 | | 2/1970 | McSorley . | |
| 4,150,499 | | 4/1979 | Wang . | |
| 4,215,492 | | 8/1980 | Sandmeier . | |
| 4,223,455 | | 9/1980 | Vermeulen . | |
| 4,255,874 | | 3/1981 | Sironi . | |
| 4,345,387 | * | 8/1982 | Daswick | 36/43 |
| 4,364,186 | | 12/1982 | Fukuoka . | |
| 4,399,621 | | 8/1983 | Dassler . | |
| 4,499,672 | | 2/1985 | Kim . | |
| 4,501,077 | | 2/1985 | Young . | |
| 4,550,510 | | 11/1985 | Stubblefield . | |
| 4,559,723 | | 12/1985 | Hamy et al. . | |
| 4,654,982 | | 4/1987 | Lee . | |
| 4,674,203 | | 6/1987 | Goller . | |
| 4,685,224 | * | 8/1987 | Anger | 36/43 |
| 4,741,114 | | 5/1988 | Stubblefield . | |
| 4,747,220 | | 5/1988 | Autry et al. . | |
| 4,760,651 | | 8/1988 | Pon-Tzu . | |
| 4,776,109 | | 10/1988 | Sacre . | |
| 4,776,110 | | 10/1988 | Shiang . | |
| 4,831,749 | | 5/1989 | Tsai . | |
| 4,843,741 | * | 7/1989 | Yung-Mao | 36/28 |
| 4,860,463 | | 8/1989 | Pin . | |
| 4,910,882 | * | 3/1990 | Goller | 36/3 B |
| 5,005,300 | | 4/1991 | Diaz et al. . | |
| 5,035,068 | | 7/1991 | Biasi . | |
| 5,167,999 | | 12/1992 | Wang . | |
| 5,224,277 | | 7/1993 | Sang Do . | |
| 5,233,767 | * | 8/1993 | Kramer | 36/28 |
| 5,269,080 | | 12/1993 | Davis . | |
| 5,282,324 | | 2/1994 | Cheng . | |
| 5,299,368 | | 4/1994 | Liu . | |
| 5,341,581 | | 8/1994 | Huang . | |
| 5,423,135 | | 6/1995 | Poole et al. . | |
| 5,440,826 | | 8/1995 | Whatley . | |
| 5,513,449 | | 5/1996 | Gramola . | |
| 5,606,806 | | 3/1997 | O'Dwyer . | |
| 5,607,749 | | 3/1997 | Strumor . | |
| 5,619,809 | | 4/1997 | Sessa . | |
| 5,621,986 | | 4/1997 | Medina et al. . | |
| 5,669,161 | | 9/1997 | Huang . | |
| 5,694,705 | | 12/1997 | Alonso Coves . | |
| 5,787,609 | | 8/1998 | Wu . | |
| 5,809,665 | | 9/1998 | Suenaga . | |
| 5,813,141 | | 9/1998 | Cho . | |
| 5,815,949 | | 10/1998 | Sessa . | |
| 5,826,349 | | 10/1998 | Goss . | |
| 5,845,418 | | 12/1998 | Chi . | |

* cited by examiner

DISPERSED-AIR FOOTPAD

This patent application is a continuation-in-part of U.S. patent application Ser. No. 09/243,074, filed Feb. 2, 1999, now abandoned the disclosure of which is incorporated herein by reference.

THE FIELD OF THE INVENTION

The present invention relates to footwear, particularly to soles and footpads, and especially to ventilated and cushioned soles and footpads.

THE BACKGROUND ART

Makers of footwear strive to offer as many as possible of the desirable functions the consumer has come to expect. In addition to meeting the ancient needs for protection from heat, cold, and trauma, the modern consumer expects to take long walks without suffering foot fatigue or irritation, to walk, run, and jump with minimal impact upon joints and vertebrae, to stand comfortably for prolonged periods, and to be free of fungal infections and offensive foot odor. The consumer also expects footwear to be lightweight, durable, affordable, beautiful, and stylish. A designer's challenge in cultivating and meeting these expectations in a competitive market is limitless. A well-designed sole or footpad is central to meeting this challenge.

Many designs for soles and footpads reflect an attempt to cushion the body from the impact of footfalls by softening and thickening the sole or footpad. While effective at absorbing shock, such a solution might not always support the foot in a way which avoids fatigue and irritation. The softer materials used in these designs, especially foams, are sometimes less durable or more likely to retain moisture, dirt, and odor. Under some circumstances, a thick sole of solid rubber or a similar material would be too heavy. Finally, a thick sole or footpad is inappropriate for some styles of footwear.

Some proposed structures for soles and footpads reflect an attempt to ventilate the interior of the shoe. Ranging from simple to exotic, these structures have taken several different, although overlapping, approaches. One approach has been to employ various interconnected pumping chambers, bladders, valves, jets, tubes, orifices, and the like. Patents exemplifying this approach include U.S. Pat. Nos. 3,180,039; 3,225,463; 4,215,492; 4,499,672; 4,654,982; 4,760,651; 4,776,109; 4,860,463; 5,010,661; 5,224,277; 5,282,324; 5,341,581; 5,606,806; 5,787,609; 5,809,665; 5,815,949; 5,813,141; and 5,826,349. The structures shown, for the most part, use the motion of walking to agitate or exchange air surrounding the foot. Some of the structures also are described as cushioning the foot. To varying degrees, these structures add to the thickness, complexity, or cost of the product. Also to varying degrees, these structures provide inaccessible spaces where water or dirt can accumulate. Finally, these structures may be prone to rupture or other failure.

A related approach to ventilation, and one which also sometimes described as cushioning the foot, employs compressible supporting structures situated in a space defined between upper and lower layers of a footpad or insole. Patents exemplifying this approach include U.S. Pat. Nos. 3,716,930; 4,223,455; 4,364,186; 4,590,689; 4,674,203; 4,910,882; 5,035,068; 5,619,809; 5,669,161; 5,675,914, and 5,845,418. To varying degrees, the structures shown experience some of the aforementioned drawbacks relating to thickness, complexity, cost, dirt, and failure.

A third approach to ventilation employs a sole or insole having ribs, beads, liquid cells, knobs, or nipples. Patents exemplifying this approach include U.S. Pat. Nos. 4,685,224; 4,831,749; 5,167,999; 5,607,749; and 5,694,705. The structures shown, for the most part, use the motion of walking to agitate or exchange the air that flows between the foot and the footpad, or between and around the ribs, nipples, or the like. Some of these structures are also described as supporting, cushioning, or massaging the foot. While some of these structures might provide less cushioning or less support than a wearer would like, they are, for the most part, simpler, lighter, and thinner than those taking the other two approaches. The versatility of these thinner, simpler structures suggests that it would be desirable to optimize the performance of products taking this general approach.

The need persists for improved soles and footpads which deliver superior combinations of the above-described desirable functions. What is especially needed is a relatively thin, simple, easily made, lightweight, durable, well ventilated sole or footpad which provides good support for walking, shock absorption, and comfortable static support.

SUMMARY OF THE INVENTION

It is an object of the present invention generally to provide for the improved ventilation of footwear articles and, more particularly, to use cyclic weighting and unweighting of the footpad to agitate and exchange air beneath the foot bottom.

It is an additional object of the present invention generally to provide a superior combination of ventilation, cushioning, and comfortable static support and, more particularly, to provide both superior ventilation when the wearer is moving about and superior comfort when the wearer is stationary or carrying a heavy load.

It is an additional object of the present invention to provide superior ventilation when the wearer is moving about and superior support when the wearer is engaged in vigorous activity or making sudden movements.

It is an additional object of the present invention to provide the aforementioned benefits in a simple, versatile footpad which may be a permanent or interchangeable part of a footwear article.

In accordance with these objects and with others which will be described and which will become apparent, an exemplary embodiment of a footpad in accordance with the present invention includes a pad having size and shape for disposition beneath the foot of a person wearing a shoe, sock, or the like. The pad has an upper surface with a plurality of lugs disposed thereon. Each lug has a top surface, a plurality of side surfaces, and a plurality of edges defined by the intersection of said side surfaces with said top surface. A plurality of the edges are defined in mutually parallel relation on mutually proximate lugs. The lugs are capable of transmitting a downward pressure incident thereupon to the pad. The lugs are capable of transition between a first condition and a second condition. The first condition exists when said downward pressure does not exceed a predetermined transition value. The second condition exists when said downward pressure exceeds the transition value. The side surfaces of said lugs in the first condition, together with the upper surface of said pad, define therebetween a void. The edges of the lugs, when in the second condition, abut and form a substantially continuous and substantially uniformly supportive surface.

In another exemplary embodiment of a footpad in accordance with the present invention, the volume of the void that is defined between the lugs decreases in volume as said downward pressure is initially applied and as that pressure begins to increase.

In another exemplary embodiment of a footpad in accordance with the present invention, the edges of a plurality of the lugs define the top surfaces of the lugs as polygonal.

In another exemplary embodiment of a footpad in accordance with the present invention, the edges of a plurality of the lugs define the top surfaces of the lugs as equiangular.

In another exemplary embodiment of a footpad in accordance with the present invention, the edges of a plurality of the lugs define the top surfaces of the lugs as hexagonal.

In another exemplary embodiment of a footpad in accordance with the present invention, the edges of a first plurality of the lugs define the top surfaces thereof as m-gonal, the edges of a second plurality of the lugs, interspersed among the first plurality of lugs, define the top surfaces thereof as being n-gonal, m and n being integers so chosen that all of the edges of the first and second pluralities of lugs are disposed in mutually parallel relation on mutually proximate lugs.

In another exemplary embodiment of a footpad in accordance with the present invention, the dimensions of the edges of the plurality of lugs are uniform.

In another exemplary embodiment of a footpad in accordance with the present invention, first and second pluralities of the lugs have first and second transition values, respectively.

In another exemplary embodiment of a footpad in accordance with the present invention, first and second pluralities of the lugs have top surfaces having first and second surface areas per lug, respectively.

In another exemplary embodiment of a footpad in accordance with the present invention, first and second pluralities of the lugs have first and second lug heights, respectively.

In another exemplary embodiment of a footpad in accordance with the present invention, first and second pluralities of the lugs have, respectively, first and second transition values and first and second lug heights, the first transition value exceeding the second transition value and the first lug height exceeding the second lug height.

In another exemplary embodiment of a footpad in accordance with the present invention, first and second pluralities of the lugs have, respectively, first and second transition values and first and second lug heights, the first transition value exceeding the second transition value and the second lug height exceeding the first lug height.

In another exemplary embodiment of a footpad in accordance with the present invention, first and second pluralities of the lugs define, respectively, first and second ratios of void volume to lug volume. Each of the respective void volumes is defined with reference to the respective heights and side surfaces of mutually proximate lugs of the respective pluralities of lugs and with reference to the upper surface of the pad, and each of the respective lug volumes is defined with reference to the respective heights, side surfaces and top surfaces of the lugs and with reference to the upper surface of the pad.

In another exemplary embodiment of a footpad in accordance with the present invention, a top surface of at least one of the lugs defines a concavity.

It is an advantage of the present invention that, under light or moderate pressure, the lugs support the foot above the upper surface of the pad so that air may carry away moisture and heat.

It is an additional advantage of the present invention that cyclic weighting and unweighting assist the exchange of air around the wearer's foot during periods of activity when ventilation is most practicable and most likely to be valued by the wearer. This advantage is compounded by the fact that at such times, the wearer's movements promote blood circulation in the foot bottom and minimize the significance of pressure points related to the presence of lugs on the footpad.

It is an additional advantage of the present invention that under heavy static loads, complementary, mutually parallel, spaced-apart edges of adjacent lugs are approximated to one another to provide a substantially continuous and substantially uniformly supportive foot-supporting surface at a time when the wearer is likely to value comfortable, smooth support over ventilation. This advantage is compounded by the fact that at such times, due to the wearer's lack of motion, motion-assisted ventilation is impracticable and pressure points are likely to cause uncomfortable localized loss of circulation in the foot bottom.

It is an additional advantage of the present invention that when heavily loaded, adjacent lugs in a foot-supporting area of the footpad tend to come into opposing contact with one another and thus tend to become more resistant to further deformation, thereby providing a firmer foot-supporting surface at a time when the wearer is likely to value support over ventilation.

It is an additional advantage of the present invention that, under the light and intermediate loads experienced during some parts of normal walking motion, the present invention achieves cushioning with the added benefit of ventilation, while, under the heavier dynamic loads that are experienced at various parts of walking and other, more strenuous movements, the present invention provides firmer, more stable support to the wearer's foot.

BRIEF DESCRIPTION OF THE-DRAWINGS

For a further understanding of the objects and advantages of the present invention, reference should be had to the following detailed description, taken in conjunction with the accompanying drawing, in which like parts are given like reference numbers and wherein.

DETAILED DESCRIPTION OF THE INVENTION

The invention will now be described with reference to FIG. 1, which illustrates a preferred embodiment of a footpad in accordance with the present invention shown generally by the numeral 10. The footpad 10 of this preferred embodiment comprises a pad 22. The pad 22 is generally flat and shaped to underlie the foot of a person wearing a footwear article. The pad 22 is formed by injection molding, lamination, or otherwise of a durable, flexible material such as rubber, plastic, leather, fabric, or a composite of these materials. Exemplary materials include thermal plastic rubber and polyvinyl chloride. The footpad 10 can range widely in thickness, a preferred range being from about 0.125 to 0.313 inches (0.318 to 0.795 cm). The pad 22 may be incorporated into and form the inner portion of the sole of a footwear article or it may be formed separately and then attached by adhesive or other fastening means.

Figure 5:
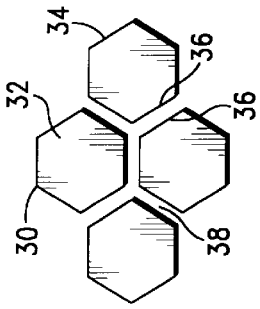
FIG. 5 is a partial plan view of a footpad in accordance with the present invention showing a plurality of hexagonal lugs.
Figure 9:
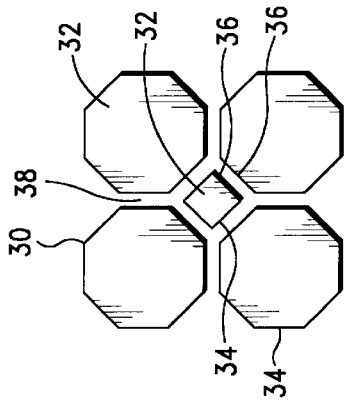
FIG. 9 is a partial plan view of a footpad in accordance with the present invention showing four octagonal lugs arranged about a square lug.
Figure 1:
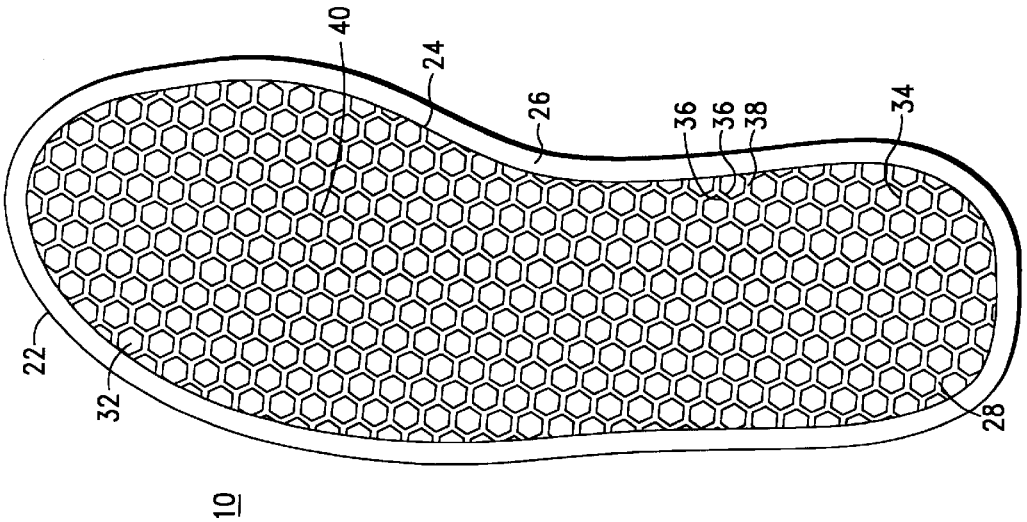
FIG. 1 is a plan view of a preferred embodiment of a footpad in accordance with the present invention.

With continued reference to FIG. 1 and now also to FIGS. 5 and 9, the pad 22 has a body 24, a periphery 26, and an upper surface 28. A plurality of upwardly projecting lugs 30 are formed on the upper surface 28 of the pad 22. Generally, each lug 30 has a top surface 32, a plurality of side surfaces 34, and a plurality of edges 36 defined by the intersection of the side surfaces 34 with the top surface 32. At some locations, such as at the periphery 26 of the footpad 10, one or more of the lugs 30 may be truncated or joined together. As drawn in FIG. 1 and as shown in finer detail in FIG. 5, the lugs 30 of this preferred embodiment are hexagonal and are arranged in a regular honeycomb pattern wherein the edges 36 of adjacent lugs 30 face one another in mutually parallel, spaced apart relation. As shown in FIG. 9, the lugs 30 of this preferred embodiment are formed integrally with the pad body 24 and are of substantially uniform height. As shown in FIG. 1, the lugs of this particular embodiment are uniformly spaced apart. Together with the upper surface 28 of the pad 22, the side surfaces 34 of adjacent lugs 30 define a void 38 which opens upwardly. This void 38 extends in a lattice-like manner over a substantial area of the footpad 10.

Within a substantial area of the footpad 10, the top surfaces 32 of the lugs 30 provide a foot-supporting surface 40. Most generally, this foot-supporting surface 40 extends over substantially all of the footpad 10. More particularly, as the term refers to the portion of the footpad 10 which is in load-bearing contact with a wearer's foot, the extent and location of the foot-supporting surface 40 will, of course, ultimately be determined from moment to moment by the shape, weight, and position of the foot and also by the person's movements. As the bottom of the wearer's foot gently comes to rest upon this foot-supporting surface 40, the top surfaces 32 of the lugs 30 will initially support the foot above the upper surface 28 of the pad 22. Under this condition, air is free to diffuse and flow in the void 38 defined between and around the lugs 30, thereby carrying away moisture and heat. The benefits generally include greater foot comfort and health, and perhaps also longer life for the footwear article as well.

Within the foot-supporting surface of the footpad 10, each lug 30 incorporates a substantial amount of a resilient material such as rubber, neoprene, silicone, or the like. Consequently, as a person begins to stand more heavily on the footpad 10, the lugs 30 transmit the increasing downward pressure into the pad body 24. In doing so, the, lugs 30, being resilient, are deformed. With increasing pressure, the top surface 32 of a lug 30 will be displaced toward the pad body 24 and the side surfaces 34 and edges 36 of adjacent lugs 30 are displaced laterally toward one another. Thus, both the height and the width of the void 38 that is defined between the foot bottom, the upper surface 28 of the pad 22, and the adjacent lugs 30 decreases as more weight is applied. As weight is added, the void volume is decreased, the pressure increased, and air forced generally toward the periphery 26 of the footpad 10. The opposite happens when the person takes weight off of the footpad 10. In general, any gentle, cyclic weighting and unweighting of the footpad 10 will alternately expel air from, and ingest air into, the foot-supporting surface 40, thereby ventilating the foot bottom.

Figure 7:
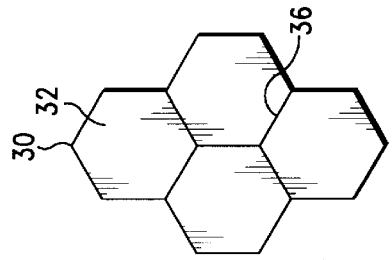
FIG. 7 is a partial plan view of a footpad in accordance with the present invention showing a plurality of hexagonal lugs, the edges of adjacent lugs being approximated together.

With continued reference to FIG. 1 and now also to FIG. 7, when a person stands very heavily on a footpad 10 in accordance with the present invention, the lugs 30 that transmit the corresponding very large downward pressure into the pad body 24 are deformed to such a degree that the side surfaces 34 of adjacent lugs 30 in the foot supporting surface 40 contact one another, substantially eliminating the void 38 between adjacent lugs 30. There being little or no further void volume for the lugs 30 to expand into, the lugs 30 become more resistant to further deformation, thereby providing a firmer foot-supporting surface 40. Additionally and with particular reference to FIG. 7, the mutually parallel, spaced-apart edges 36 of adjacent lugs 30 define a complementary arrangement of top surfaces 32 of adjacent lugs 30, such that the top surfaces 32 of adjacent lugs 30 are approximated to one another to provide a substantially continuous and substantially uniformly supportive foot-supporting surface 40.

With continued reference to FIGS. 1 and 7, in this preferred embodiment, this cooperation between adjacent lugs 30 is achieved at a downward pressure corresponding to a weight value predetermined to be that exerted by most of the persons who would be using the footpad, standing stationary with left and right feet equally weighted. For example, if an acceptably high percentage of the persons whose shoes require a footpad of a particular size—e.g., U.S. men's size 9—are estimated to exert 60 lbs. on each footpad when standing stationary on a level surface, then the lugs 30 within the foot-supporting surface 40 of each such footpad would have dimensions and bulk properties such that the top surfaces 32 of adjacent lugs 30 will be approximated to one another to provide a substantially continuous and substantially uniformly supportive foot-supporting surface 40 when loaded at a downward pressure corresponding to a weight of 60 lbs. on each foot. If the pad body 24 or the undersole upon which the pad 22 rests is irregular or highly deformable, some further adjustment of dimensions or bulk properties of the lugs 30 might be appropriate to achieve the desired result at the pre-determined weight. In the context of the present invention, the downward pressure at which this cooperation occurs is referred to as the transition value. At a given moment, of course, some portions of the footpad 10 may be subjected to a downward pressure less than the transition value while others are being subjected to a downward pressure greater than the transition value.

Among the advantages of this preferred embodiment is the delivery of a superior combination of ventilation, cushioning, and comfortable static support in a relatively simple, versatile footpad. A superior tradeoff is achieved between ventilation and static support. The present invention reflects a recognition that the cyclic weighting and unweighting that are useful for exchanging air around the foot bottom will occur most often when a person is active and especially when he or she is walking. This is also the time during which cyclic weighting and unweighting will promote blood circulation in the foot bottom. Accordingly, discomfort is not likely to result from any pressure points corresponding to the lugs 30 of the footpad 10. Conversely, pressure points can indeed be expected eventually to cause discomfort to a foot bearing a heavy static load for a prolonged period. The present invention reflects a recognition that when a heavy static load must be borne, it is more comfortably borne over a uniformly supportive surface. Under heavy loads where ventilation is less practicable, the present invention provides a more comfortable foot-supporting surface 40.

The present invention further reflects a recognition that while many persons appreciate footwear which lessens the impact upon their bodies of normal walking motion, many persons also appreciate footwear which provides firm support for carrying the dynamic loads associated with turning, darting, jumping, dodging, dancing, climbing stairs, recovering lost balance, and other such activities. At such times, many persons will regard solid, stable support as far more important than cushioning. Under the light and intermediate loads experienced during some parts of normal walking motion, the present invention achieves cushioning with the added benefit of ventilation, as the lugs 30 cyclically expand and contract into the void volume with relative ease and air is cyclically expelled and ingested. Under the heavier dynamic loads that are experienced at various parts of walking and other, more strenuous movements, the present invention provides a firmer, more stable foot-supporting surface 40.

Figure 2:
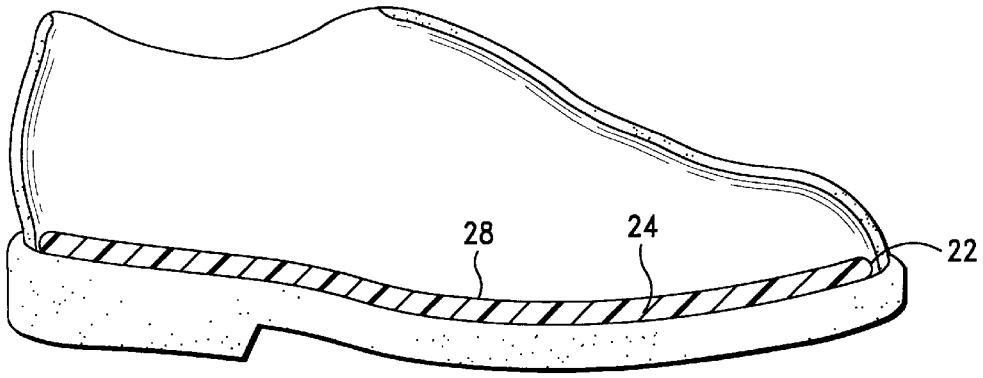
FIG. 2 is a side elevational-sectional view of a footpad in accordance with the present invention shown installed in a shoe.
Figure 3:
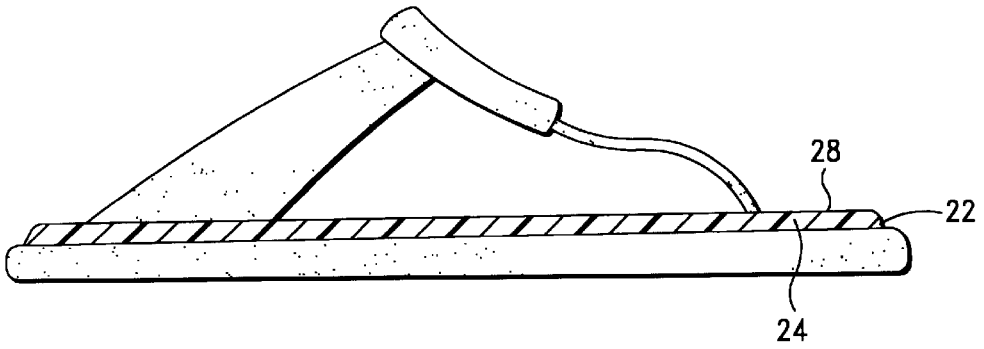
FIG. 3 is a side elevational-sectional view of a footpad in accordance with the present invention shown installed in a thong.

With reference now to FIGS. 2 and 3, this preferred embodiment is shown incorporated into the sole portion of a shoe or slipper, respectively. A slipper is commonly worn during relatively sedentary periods at home or on a long flight. When a person is seated, the slipper may be supporting only a portion of the weight of one leg. Moreover, a slipper is rarely worn for strenuous activities and is less often required to absorb shock or support athletic movements. Accordingly, a footpad in accordance with the present invention may be constructed so that the top surfaces 32 of adjacent lugs 30 are approximated to one another to provide a substantially continuous and substantially uniformly supportive foot-supporting surface 40 even when a relatively light weight is being applied. Thus, for use in a slipper, the transition value might preferably be lower than for use in a work boot or a walking or sport shoe.

The tradeoff between ventilation, cushioning, and firmness and uniformity of support will likely depend on the environment and on the wearer's personal preference. A tradeoff more strongly in favor of uniformity of support may be accomplished, for example, by using a softer material for the lugs 30, by reducing the separation between adjacent lugs 30, by increasing their height, or by any combination of these means tending to allow the top surfaces 32 of adjacent lugs 30 to become approximated to one another and to provide a substantially continuous and substantially uniformly supportive foot-supporting surface 40 while transmitting a relatively lower downward pressure into the pad body 24.

Figure 11:
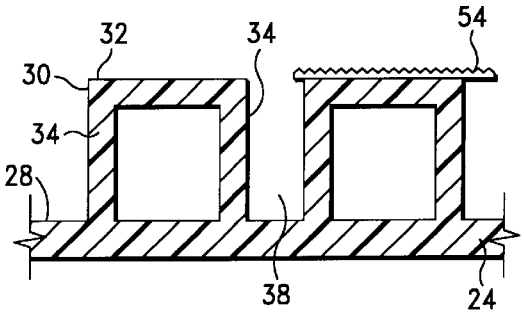
FIG. 11 is a partial elevational view of a footpad in accordance with the present invention showing a plurality of fluid-containing lugs, a liner being disposed over one lug.
Figure 12:
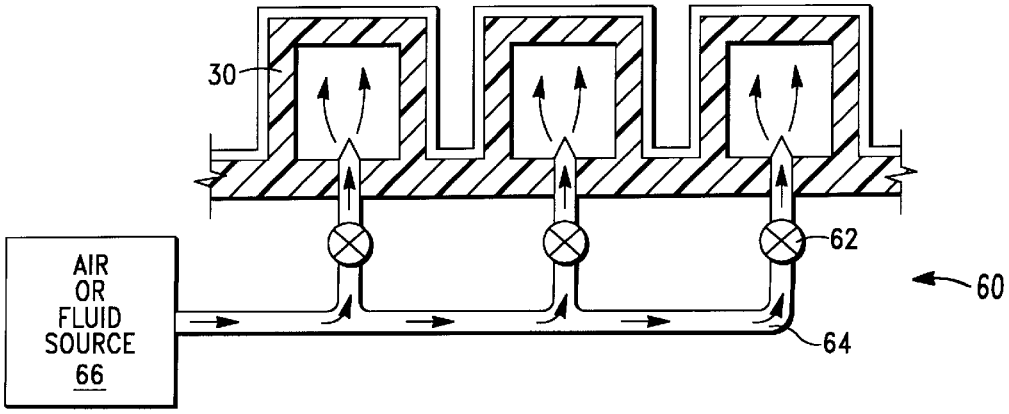
FIG. 12 is a block diagram of an apparatus for forming and sealing fluid-containing lugs.

With reference now to FIGS. 11 and 12, an additional means of altering the characteristics of the lugs 30 is to incorporate a fluid within the lugs 30. As shown in FIG. 11, the pad body 24 and the top surface 32 and side surfaces 34 of a lug 30 define an interior volume which may contain a gas, a liquid, or a viscous or plastic material. Such a structure may be made on any of a number of machines commonly used for molding an article of a polymeric or other resinous material, injecting a volume of a second material into the article or trapping same between layers thereof, and sealing the second material within the finished article. Optionally, a covering layer 54 may be disposed over a portion of the footpad 10 or over a portion of a top surface 32 of one or more lugs 30 thereof. FIG. 12 represents an injection molding apparatus 60 having one or more air or fluid filling valves 62 which are connected via manifold 64 to an air or fluid source 66. This apparatus 60 punctures the lugs 30 and injects a controlled quantity of air or fluid therein, typically at a pressure of between 10 and 25 psi. The valves are retracted and the heated resin collapses inward, sealing the air or fluid within the lugs 30.

A relatively large portion of the resin that is displaced from the portions of the lugs 30 that form the top surfaces 32 and side surfaces 34 thereof (as air or fluid is injected) flows into the pad body 24, leaving the side surfaces 34 of the lugs 30 relatively thin and relatively flexible and collapsible. Accordingly, when weight is ultimately applied to the lugs 30, the material trapped within the lugs 30 is compressed and transmits the greater part of the downward pressure into the pad body 24. The side surfaces 34 of the lugs 30, although strong enough to confine the compressed material, are flexible enough to ripple, bow, or fold rather than to stand rigidly and cause pressure points.

Figure 4:
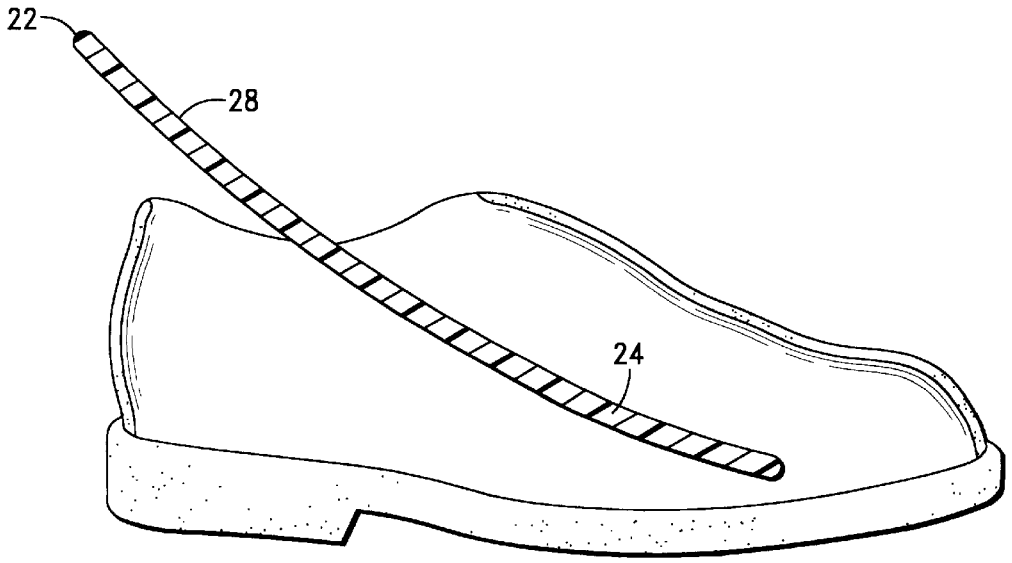
FIG. 4 is a side elevational-sectional view of a footpad in accordance with the present invention shown being inserted into a shoe.
Figure 10:
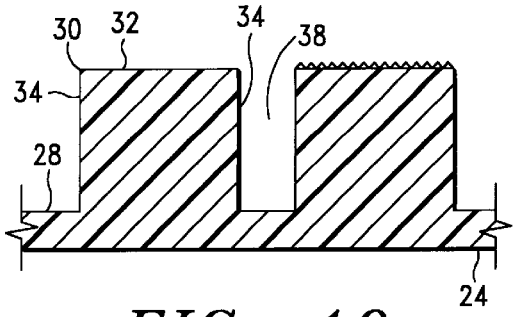
FIG. 10 is a partial elevational view of a footpad in accordance with the present invention showing solid lugs.

With reference now to FIG. 4, an insertable and removable embodiment of a footpad in accordance with the present invention is shown half way removed from a shoe or boot. This embodiment functions best when the periphery 26 of the footpad is well matched to the space immediately atop the sole within the shoe, so that the footpad has little room in which to slide around. One advantage of this embodiment is that it is interchangeable, allowing either the seller or the user of an article of footwear quickly and conveniently to alter the ventilation, cushioning, and support characteristics of a footwear article.

Figure 6:
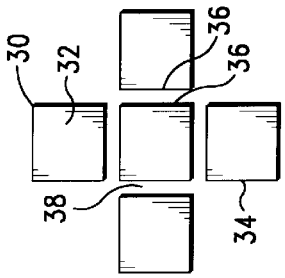
FIG. 6 is a partial plan view of a footpad in accordance with the present invention showing a plurality of square lugs.
Figure 8:
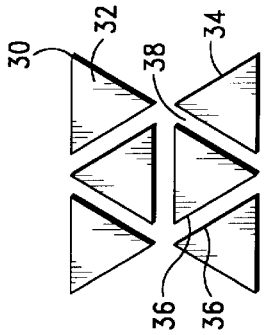
FIG. 8 is a partial plan view of a footpad in accordance with the present invention showing a plurality of triangular lugs.

With reference now to FIGS. 6, 8, and 9, other preferred embodiments of a footpad in accordance with the present invention are shown in which the lugs 30 are of rectangular, triangular, or mixed shapes, respectively. It will be appreciated that the edges 36 of adjacent lugs 30 face one another in mutually parallel, spaced apart relation in each of the exemplary configurations shown in FIGS. 6, 8, and 9. FIG. 9 exemplifies an arrangement of lugs 30 of more than one shape, the shapes, however, being in complementary arrangement. In this exemplary embodiment, square and octagonal lugs 30 are interspersed, a square lug generally being centered between four octagonal lugs and being rotated so that the edges of the octagonal and square lugs are in a mutually complementary relationship. More generally described, such an exemplary embodiment has lugs 30 configured such that the edges 36 of a first plurality of the lugs 30 define the top surfaces 32 thereof as m-gonal and the edges of a second plurality 36 of lugs 30, interspersed among the first plurality of lugs 30, define the top surfaces 32 thereof as being n-gonal. M and n are integers chosen that the first and second pluralities of lugs 30 may be arranged in positions and rotations such that all of the edges 36 of the first and second pluralities of lugs 30 within a chosen area of the footpad 10 are disposed in mutually parallel relation on mutually proximate lugs 30. It will moreover be appreciated that, in each of these exemplary configurations, the top surfaces 32 of adjacent lugs 30 will be approximated to one another to provide a substantially continuous and substantially uniformly supportive foot-supporting surface 40 when the lugs 30 are transmitting a downward pressure equal to or greater than the transition value.

Figure 13:
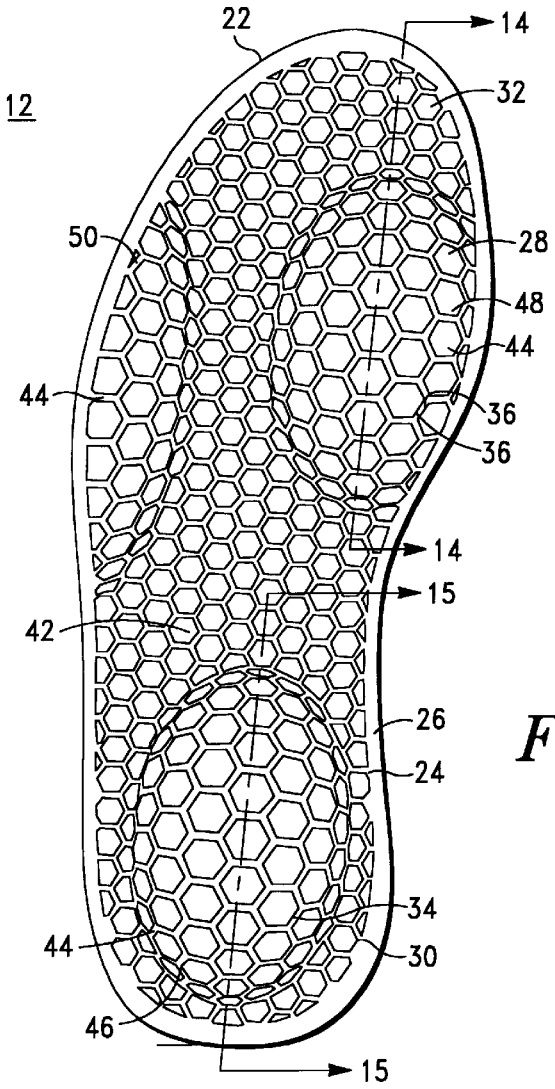
FIG. 13 is a plan view of a footpad in accordance with the present invention showing a plurality of enhanced support areas.
Figure 14:
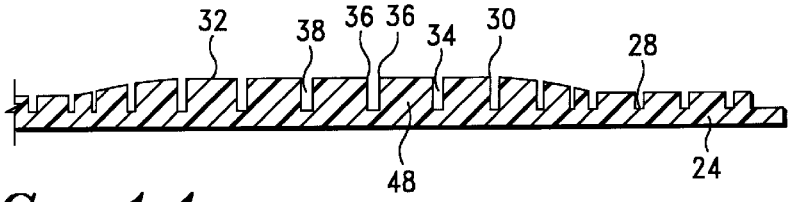
FIG. 14 is a cross-sectional view of the footpad taken along the lines 14—14 of FIG. 13.
Figure 15:
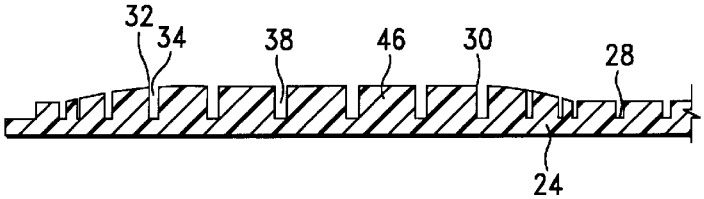
FIG. 15 is a cross-sectional view of the footpad taken along the lines 15—15 of FIG. 13.

With reference now to FIGS. 13, 14, and 15, additional preferred embodiments of a footpad in accordance with the present invention are described. FIG. 13 shows a footpad generally at 12, a pad 22, body 24, periphery 26, upper pad surface 28, and lugs 30 having top surfaces 32, side surfaces 34, and edges 36, defining a void 38 therebetween much as discussed previously with reference to FIG. 1. Over a substantial portion of the footpad 12 the top surfaces 32 of the lugs 30 define a foot-supporting surface 42. The lugs 30 incorporate a substantial amount of a resilient material and are deformable responsive to downward pressure applied to their top surfaces 32. As discussed previously with reference to FIGS. 1 and 7, the lugs 30 are deformable, and the void volume defined therebetween variable, in response to changes in the downward pressure applied to the top surfaces 32 of the lugs 30 during periods of activity. Also as discussed generally with reference to FIGS. 1 and 7 and as discussed in greater detail below, a plurality of adjacent lugs 30 cooperate when under relatively heavy pressure to provide a substantially continuous and substantially uniformly supportive foot-supporting surface 42. In the preferred embodiments represented by FIG. 13, enhanced support areas 44 are defined on a heel portion 46, a ball portion 48, and an outer edge portion 50 of the foot-supporting surface 42 of the footpad 12. These enhanced support areas 44 are positioned to underlie three portions of the human foot which usually bear particularly heavy loads, especially during work and athletic activities.

As is generally seen in FIG. 13, the individual lugs 30 within these enhanced support areas 44 each cover a larger area than do the individual lugs 30 covering the balance of the footpad 12. Nevertheless, in this embodiment, as in the embodiment shown in FIG. 1 above, over a substantial portion of each of these enhanced support areas 44, the edges 36 of adjacent lugs 30 face one another in mutually parallel, spaced apart relation and define a generally complementary arrangement of edges 36 and side surfaces 34. Over a substantial portion of each of these enhanced support areas 44, the top surfaces 32 of adjacent lugs 30 will be approximated to one another to provide a substantially continuous and substantially uniformly supportive foot-supporting surface when the lugs 30 are transmitting a downward pressure equal to or greater than the transition value for these particular lugs 30.

In the embodiment shown in FIG. 13, the spaced apart edges 36 of adjacent lugs 30 define a void 38 which is of substantially uniform width even though the lugs 30 themselves are variable in shape and are generally greater in area compared with lugs 30 over the balance of the footpad 12. Consequently, within the enhanced support areas 44, the lugs 30 cover a greater fraction of the total area than is the case outside the enhanced support areas 44. Thus, compared with the lugs 30 over the balance of the footpad 12, the lugs 30 in the enhanced support areas 44 have less void volume to expand into. It will further be appreciated that these lugs 30 will tend less readily to expand laterally in response to whatever downward pressure is applied to them and will, therefore, provide a firmer foot-supporting surface than that provided over the balance of the footpad 12. If the footpad 12 is intended to provide firm support for very athletic dodging or dashing movements, the transition value associated with the lugs 30 over a given portion of one of these enhanced support areas 44 can preferably be relatively high compared with that for lugs 30 over the balance of the footpad 12.

The wearer of a footwear article including a footpad in accordance with the embodiment of the present invention shown in FIG. 13 will enjoy enhanced support under those areas of the foot that can most advantageously use that support to carry weight, turn, jump, dash, climb, or the like. Additionally, ventilation and cushioning will be favored to some degree over uniformity of support during periods when the enhanced support areas 44 are not heavily weighted. Accordingly, this embodiment of the present invention achieves an advantageous tradeoff between ventilation, cushioning, and firmness and uniformity of support and, in addition, tailors that tradeoff to particular portions of the foot.

With continued reference to FIG. 13, and now with additional reference to FIGS. 14, and 15, yet another preferred embodiment is described wherein the lugs 30 in the enhanced support areas 44 are taller than the lugs 30 over the balance of the footpad 12. FIGS. 14 and 15 represent respective cross-sectional views of the ball portion 48 and heel portion 46 of a footpad 12 as shown generally by FIG. 13. As the bottom of a person's foot gently comes to rest upon the footpad 12, the top surfaces 32 of the lugs 30 in the enhanced support areas 44 will initially support the foot above the upper surface 28 of the pad 22 and, to some degree when the applied weight is very light, support the foot bottom at a level barely contacting the top surfaces 32 of the lugs 30 over certain parts of the balance of the footpad 12. As a consequence, the ventilation of those parts of the footpad 12 that lie between the enhanced support areas 44 will be promoted. In this embodiment, the height of the lugs 30 in the enhanced support areas 44 is ultimately determined on the basis of overall design considerations and user preferences, and ranges typically from 0.2 to 0.5 inches. Preferably, the transition in lug height between the enhanced support areas 44 and any adjacent areas of the footpad 12 is gradual so as to avoid large discontinuities of height between adjacent lugs 30 and between the edges 36 thereof.

As a person begins to stand more heavily on the footpad 12, the resilient lugs 30 are deformed. Ventilation and cushioning are enjoyed together as the side surfaces 34 of the lugs 30 expand and contract into the void 38 responsive to any gentle, cyclic weighting and unweighting of the footpad 12. When much heavier weight is applied, such that the downward pressure on the lugs 30 in the enhanced support areas 44 equals or exceeds the transition value for those lugs 30, the top surfaces 32 of adjacent lugs 30 will be approximated to one another to provide a substantially continuous and substantially uniformly supportive foot-supporting surface. However, having greater initial height than the lugs 30 over the balance of the footpad 12, the lugs 30 in the enhanced support areas 44 will provide greater cushioning as their top surfaces 32 are displaced downward over a greater distance responsive to a given downward pressure. Thus, the embodiments represented by FIGS. 14 and 15 provide enhanced support and cushioning for three load bearing portions of the human foot and enhanced foot ventilation overall.

Figure 16:
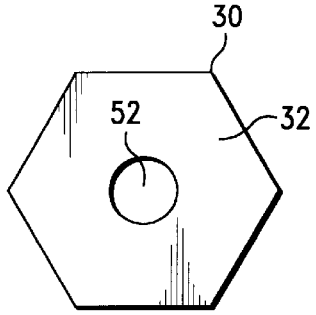
FIG. 16 is a plan view of a single lug of a footpad in accordance with the present invention showing a cavity formed in the top surface of the lug.
Figure 17:
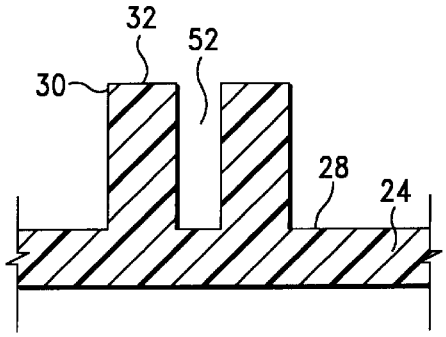
FIG. 17 is a partial elevational view of a lug of a footpad in accordance with the present invention showing a cavity formed in the top surface of the lug.

With reference now to FIGS. 16 and 17, yet another exemplary embodiment of a footpad in accordance with the present invention is described wherein a cavity 52 is defined in a top surface 32 of at least one lug 30. A cavity 52 such as the one shown may be formed as a means of rendering a lug 30 more easily deformable responsive to downward pressure. In the preferred embodiment shown in FIG. 17, the cavity 52 is cylindrical and is as deep as the lug 30 is tall, thereby providing the maximum additional void volume for a given cavity diameter. Indeed, several such cavities 52 may be added to a lug 30. The diameter of the cavity 52 may be limited, or its shape modified to an oval or similar shape, in the interest of preserving or enhancing the uniformity of support provided by the top surfaces 32 of the lugs 30 under heavy weight.

Figure 18:
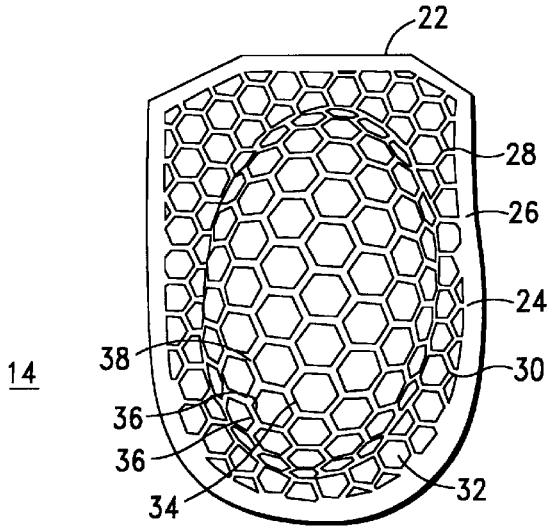
FIG. 18 is a plan view of a footpad in accordance with the present invention configured as a heel section.

With reference now to FIG. 18, an exemplary embodiment of a footpad in accordance with the present invention comprises a heel section for a sole or insole of a footwear article. The heel section, shown generally at 14, includes a pad 22, body 24, periphery 26, upper pad surface 28, and lugs 30 having top surfaces 32, side surfaces 34, and edges 36, defining a void 38 therebetween and, having structure and cooperation as discussed previously with reference to FIGS. 13 and 15. As discussed previously with reference to FIGS. 1–4, the heel section may formed integrally with the sole portion of a footwear article or may be formed separately and either attached or deposited atop the sole portion. Yet another alternative embodiment of a heel section according to the present invention may be provided by forming only the heel portion of a footpad of the type described with reference to FIG. 1, the heel section being cut or molded to a shape corresponding to a heel portion of a footwear article in the same manner as shown by FIG. 18.

While the foregoing detailed description has described several embodiments of a footpad in accordance with the present invention, it is to be understood that the above description is illustrative only and not limiting of the disclosed invention. Textured top surfaces 32 may be provided on the lugs 30. A covering, textured or not, may be provided over the footpad. The footpad need not cover the entire sole of a footwear article; it may be provided for, attached to, or incorporated into, any lesser area of the sole. Particularly, the lugs 30 need not be limited exclusively to equi-angular or regular polygonal shapes, nor even to polygonal shapes; curved shapes may be provided so long as the essential cooperation between adjacent lugs 30 is preserved. Additionally, to the extent practicable within the present invention, the enhanced support areas 44 may be defined with reference to the comparative area, height, or separation of the lugs 30, with reference to a bulk property of the lugs 30, or with reference to any combination of these variables. It will be appreciated that the embodiments discussed above and the virtually infinite embodiments that are not mentioned could easily be within the scope and spirit of the present invention. Thus, the present invention is to be limited only by the claims as set forth below.

What is claimed is:

1. A footpad, comprising:

a pad having size and shape for load-bearing disposition in a shoe, sock, or the like, said pad having an upper surface;

a plurality of lugs disposed on said upper surface;

each said lug having a top surface, a plurality of side surfaces, and a plurality of edges defined by the intersection of said side surfaces with said top surface;

a plurality of said edges being defined in mutually parallel relation on mutually proximate lugs;

said lugs being located to receive a downward pressure incident upon said top surfaces thereof and to transmit said downward pressure to said pad;

said lugs being capable of transition between a first condition and a second condition, said first condition obtaining when said downward pressure does not exceed a predetermined transition value, said second condition obtaining when said downward pressure exceeds said transition value;

said side surfaces of said lugs in said first condition, together with said upper surface of said pad, defining therebetween a void;

said edges of said lugs in said second condition abutting and forming a substantially continuous and substantially uniformly supportive surface, said edges of a plurality of said lugs defining the top surfaces of said lugs as polygonal;

said edges of a first plurality of said lugs defining said top surfaces thereof as m-gonal, said edges of a second plurality of said lugs, interspersed among said first plurality of lugs, defining said top surfaces thereof as being n-gonal, m and n being unequal integers so chosen, and said lugs being so placed and so oriented, that a plurality of edges of said first and second pluralities of lugs are disposed in mutually parallel relation on mutually proximate lugs.

2. A footpad as set forth in claim 1, wherein m=8 and n=4.

3. A footpad as set forth in claim 2, comprising interspersed arrayed octagonal and quadrilateral lugs.

4. A footpad as set forth in claim 3, wherein said octagonal and quadrilateral lugs are substantially regularly arrayed.

5. A footpad as set forth in claim 3, wherein said octagonal lugs are regular octagonal lugs and said quadrilateral lugs are regular quadrilateral lugs, each of at least one of said quadrilateral lugs being located equidistant from four of said octagonal lugs.

6. A footpad as set forth in claim 3, wherein said quadrilateral lugs are regular quadrilateral lugs and said octagonal lugs are regular octagonal lugs, each of at least one of said octagonal lugs being located equidistant from four of said quadrilateral lugs.

* * * * *